US010482840B2

(12) United States Patent
Zhang et al.

(10) Patent No.: US 10,482,840 B2
(45) Date of Patent: Nov. 19, 2019

(54) DATA VOLTAGE ADJUSTING METHOD OF LIQUID CRYSTAL DISPLAY PANEL AND DEVICE

(71) Applicant: Shenzhen China Star Optoelectronics Technology Co., Ltd., Shenzhen, Guangdong (CN)

(72) Inventors: Mengmeng Zhang, Guangdong (CN); Shuai Chen, Guangdong (CN); Liyang An, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 17 days.

(21) Appl. No.: 15/545,713

(22) PCT Filed: May 8, 2017

(86) PCT No.: PCT/CN2017/083510

§ 371 (c)(1),
(2) Date: Jul. 23, 2017

(87) PCT Pub. No.: WO2018/176578

PCT Pub. Date: Oct. 4, 2018

(65) Prior Publication Data

US 2019/0103068 A1 Apr. 4, 2019

(30) Foreign Application Priority Data

Mar. 31, 2017 (CN) ..... 2017 1 0210573

(51) Int. Cl.
*G09G 3/36* (2006.01)

(52) U.S. Cl.
CPC ..... *G09G 3/3688* (2013.01); *G09G 3/3611* (2013.01); *G09G 2320/0209* (2013.01); *G09G 2320/0223* (2013.01)

(58) Field of Classification Search
CPC ..... G09G 3/3688; G09G 3/3611; G09G 2320/0223; G09G 2320/0209
See application file for complete search history.

(56) References Cited

U.S. PATENT DOCUMENTS 5,841,410 A * 11/1998 Oda ..... G09G 3/3648 345/58
9,218,791 B2 12/2015 Irie et al.

FOREIGN PATENT DOCUMENTS

CN 101329843 A 12/2008
CN 101882422 A 11/2010
(Continued)

*Primary Examiner* — Jonathan A Boyd
(74) *Attorney, Agent, or Firm* — Andrew C. Cheng

(57) ABSTRACT

The embodiment of the present invention provides a data voltage adjusting method of a liquid crystal display panel, comprising: obtaining a total variation amount of data voltages on all data lines in the liquid crystal display panel; calculating a maximum variation amount of the data voltages corresponding to a horizontal crosstalk index according to the horizontal crosstalk index of the liquid crystal display panel; determining whether an absolute value of the total variation amount of the data voltages is larger than an absolute value of the maximum variation amount of the data voltages corresponding to the horizontal crosstalk index; if yes, implementing a data voltage adjustment to data lines, in which with data voltages having variations in the liquid crystal display panel according to the total variation amount of the data voltages. The embodiment of the present invention further provides a data voltage adjusting device of a liquid crystal display panel.

8 Claims, 6 Drawing Sheets

(56) References Cited

FOREIGN PATENT DOCUMENTS

| | | | |
|---|---|---|---|
| CN | 102243849 | A | 11/2011 |
| CN | 104505047 | A | 4/2015 |

* cited by examiner

DATA VOLTAGE ADJUSTING METHOD OF LIQUID CRYSTAL DISPLAY PANEL AND DEVICE

CROSS REFERENCE

This application claims the priority of Chinese Patent Application No. 201710210573.0, entitled "Data voltage adjusting method of liquid crystal display panel and device", filed on Mar. 31, 2017, the disclosure of which is incorporated herein by reference in its entirety.

FIELD OF THE INVENTION

The present invention relates to a display technology field, and more particularly to a data voltage adjusting method of a liquid crystal display panel and a device.

BACKGROUND OF THE INVENTION

With the development of the liquid crystal display technology, the high resolution, the wide viewing angle, the high response speed, the high aperture rate and other requirements to the Thin Film Transistor Liquid Crystal Display (TFT-LCD) are getting higher and higher. Meanwhile, the line gaps on the TFT substrate is getting smaller and smaller with the reduction of pixel size, and the coupling between different signal lines intensifies. When a signal jump happens, it may affect the stability of other signals around. For instance, as the data voltage jump on the data line happened, the coupling will cause the common voltage jump on the common electrode line of the liquid crystal capacitor. The instability of the common voltage causes a horizontal crosstalk defect in the liquid crystal display panel, which makes against the promotion of the display quality.

SUMMARY OF THE INVENTION

The embodiment of the present invention provides a data voltage adjusting method of a liquid crystal display panel and a device.

A data voltage adjusting method of a liquid crystal display panel, comprising steps of:

obtaining a total variation amount of data voltages on all data lines in the liquid crystal display panel;

calculating a maximum variation amount of the data voltages corresponding to a horizontal crosstalk index according to the horizontal crosstalk index of the liquid crystal display panel;

determining whether an absolute value of the total variation amount of the data voltages is larger than an absolute value of the maximum variation amount of the data voltages corresponding to the horizontal crosstalk index;

if yes, implementing a data voltage adjustment to data lines with data voltages having variations in the liquid crystal display panel according to the total variation amount of the data voltages.

The step of obtaining the total variation amount of the data voltages on all the data lines in the liquid crystal display panel comprises:

obtaining a sum of positive variation amounts of the data voltages on all the data lines in the liquid crystal display panel;

obtaining a sum of negative variation amounts of the data voltages on all the data lines in the liquid crystal display panel;

calculating the total variation amount of the data voltages on all the data lines in the liquid crystal display panel according to the sum of the positive variation amounts of the data voltages and the sum of the negative variation amount of the data voltages.

The step of implementing the data voltage adjustment to the data lines with the data voltages having the variations in the liquid crystal display panel according to the total variation amount of the data voltages comprises:

obtaining an amount of the data lines the data voltages having the variations in the liquid crystal display panel;

calculating an average variation amount of the data voltages on all the data lines with the data voltages having the variations according to the total variation amount and the amount of the data lines with the data voltages having the variations;

implementing the data voltage adjustment to the data lines with the data voltages having the variations in the liquid crystal display panel according to the average variation amount of the data voltages.

The step of implementing the data voltage adjustment to the data lines with the data voltages having the variations in the liquid crystal display panel according to the average variation amount of the data voltages comprises:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

An absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

A data voltage adjusting device of a liquid crystal display panel, comprising:

a total amount obtaining unit, obtaining a total variation amount of data voltages on all data lines in the liquid crystal display panel;

a variation amount calculating unit, calculating a maximum variation amount of the data voltages corresponding to a horizontal crosstalk index according to the horizontal crosstalk index of the liquid crystal display panel;

a variation amount determining unit, determining whether an absolute value of the total variation amount of the data voltages is larger than an absolute value of the maximum variation amount of the data voltages corresponding to the horizontal crosstalk index;

a data voltage adjusting unit, implementing a data voltage adjustment to data lines with data voltages having variations in the liquid crystal display panel according to the total variation amount of the data voltages when a determining result of the variation amount determining unit is yes.

The total amount obtaining unit comprises:

a first obtaining sub unit, obtaining a sum of positive variation amounts of the data voltages on all the data lines in the liquid crystal display panel;

a second obtaining sub unit, obtaining a sum of negative variation amounts of the data voltages on all the data lines in the liquid crystal display panel;

a variation calculating sub unit, calculating the total variation amount of the data voltages on all the data lines in the liquid crystal display panel according to the sum of the positive variation amounts of the data voltages and the sum of the negative variation amount of the data voltages.

The data voltage adjusting unit comprises:

an amount obtaining sub unit, obtaining an amount of the data lines with the data voltages having the variations in the liquid crystal display panel;

an average amount calculating sub unit, calculating an average variation amount of the data voltages on all the data lines with the data voltages having the variations according to the total variation amount and the amount of the data lines with the data voltages having the variations;

a voltage adjusting sub unit, implementing the data voltage adjustment to the data lines with the data voltages having the variations in the liquid crystal display panel according to the average variation amount of the data voltages.

The voltage adjusting sub unit is further employed for:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

An absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

The data voltage adjusting method of the liquid crystal display panel and the device obtains a total variation amount of data voltages on all data lines in the liquid crystal display panel, and obtains a maximum variation amount of the data voltages corresponding to a horizontal crosstalk index of the liquid crystal display panel, and thus as an absolute value of the total variation amount of the data voltages is larger than an absolute value of the maximum variation amount of the data voltages corresponding to the horizontal crosstalk index, a data voltage adjustment is implemented to data lines with data voltages having variations in the liquid crystal display panel according to the total variation amount of the data voltages. Accordingly, it can effectively avoid the influence of the overlarge total variation amount of the data voltages to the stability of the common voltage of the liquid crystal display panel to prevent the horizontal crosstalk and to promote the display quality of the liquid crystal display panel.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Spatially relative terms, such as "below", "beneath", "lower", "above", "upper" and the like, may be used herein for ease of description to describe one element or feature's relationship to another element(s) or feature as illustrated in the figures. It can be understood that when an element or layer is referred to as being "on", "connected to" or "coupled to" another element or layer, it can be directly on the other element or layer or intervening elements or layers may be present. In contrast, when an element is referred to as being "directly on", "directly connected to" or "directly coupled to" another element or layer, there are no intervening elements or layers present.

It is understandable that the terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Figure 1:
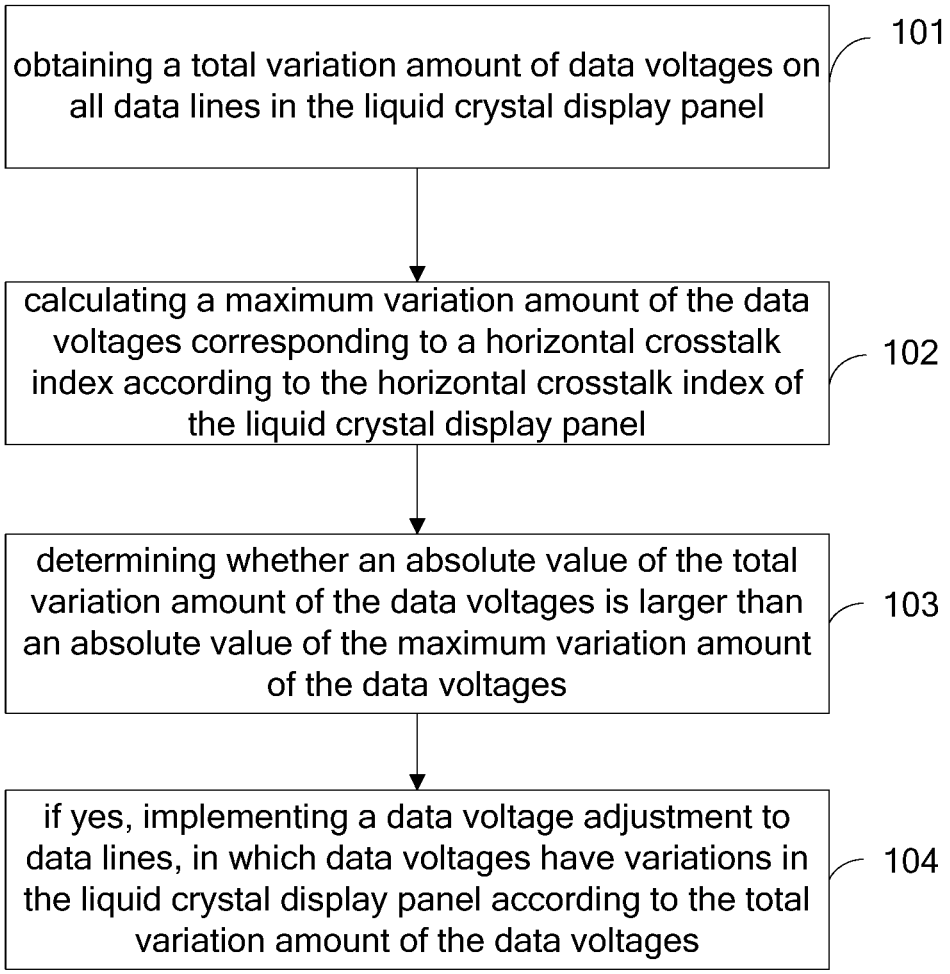
FIG. 1 is a first flowchart of a data voltage adjusting method according to the embodiment of the present invention.

Please refer to FIG. 1. In one embodiment of the present invention, provided is a data voltage adjusting method of a liquid crystal display panel, applied in a Thin Film Transistor Liquid Crystal Display (TFT-LCD) to avoid the influence of the voltage jump to the stability of the common voltage of the liquid crystal display panel to prevent the horizontal crosstalk and to promote the display quality of the liquid crystal display panel. The data voltage adjusting method at least comprises steps of:

step 101: obtaining a total variation amount of data voltages on all data lines in the liquid crystal display panel;

step 102: calculating a maximum variation amount of the data voltages corresponding to a horizontal crosstalk index according to the horizontal crosstalk index of the liquid crystal display panel;

step 103: determining whether an absolute value of the total variation amount of the data voltages is larger than an absolute value of the maximum variation amount of the data voltages corresponding to the horizontal crosstalk index;

step 104: if yes, implementing a data voltage adjustment to data lines with data voltages having variations in the liquid crystal display panel according to the total variation amount of the data voltages.

In this embodiment, the liquid crystal display panel driven in the column inversion mode is illustrated for the description of the data voltage adjusting method. In the liquid crystal display panel driven in the column inversion mode, it is assumed that the polarity of the common voltage on the common electrode is positive, and the positive polarity of the data voltage is greater than the common voltage, and the negative polarity of the data voltage is less than the common voltage, and both the data voltage of the positive polarity and the data voltage of the negative polarity are greater than zero.

Figure 2:
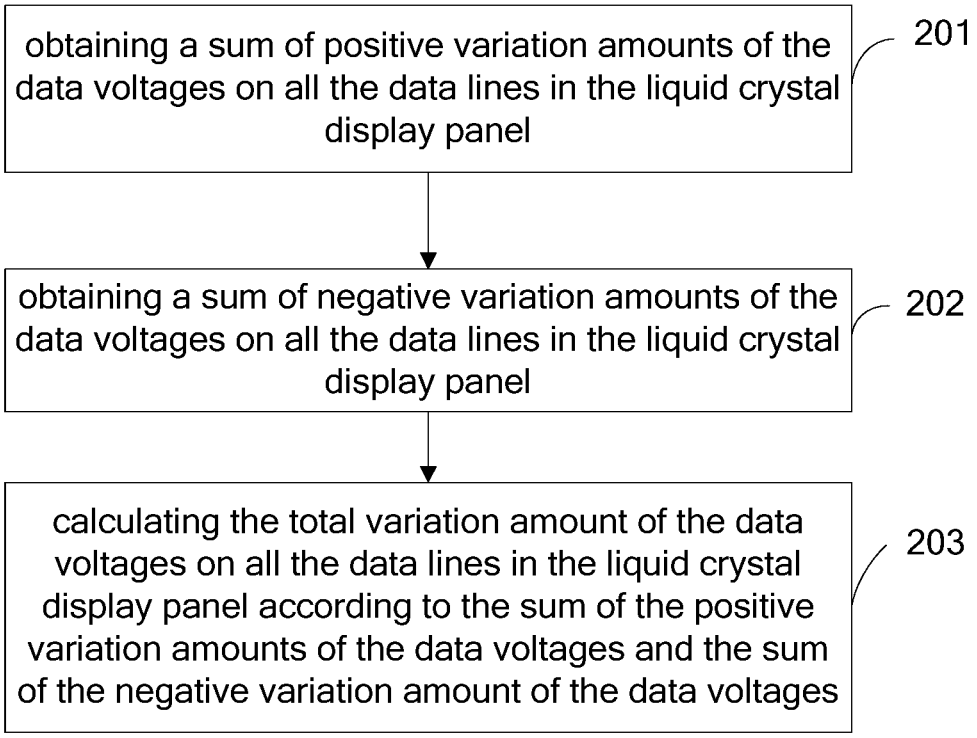
FIG. 2 is a second flowchart of a data voltage adjusting method according to the embodiment of the present invention.

Please refer to FIG. 2. In one embodiment, the step of obtaining the total variation amount of the data voltages on all the data lines in the liquid crystal display panel comprises:

step 201, obtaining a sum of positive variation amounts of the data voltages on all the data lines in the liquid crystal display panel;

step 202, obtaining a sum of negative variation amounts of the data voltages on all the data lines in the liquid crystal display panel;

step 203, calculating the total variation amount of the data voltages on all the data lines in the liquid crystal display panel according to the sum of the positive variation amounts of the data voltages and the sum of the negative variation amount of the data voltages.

Specifically, as the scanning signal on the scanning line of some row on the liquid crystal display panel is turned off and the scanning signal on the scanning line of the next row is turned on, the data voltage jump on the data line will happen if there is a change in the gray scale.

Figure 3:
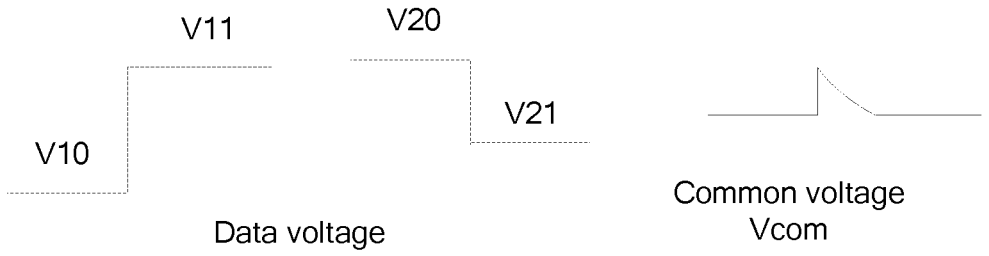
FIG. 3 is a first data voltage jump waveform diagram of a data voltage adjusting method according to the embodiment of the present invention.

Please refer to FIG. 3. In a possible way, it is assumed that the data voltages on a portion of the data lines are increased from V10 to V11, i.e. the positive variation amount of the data voltage is $\Delta V1=V11-V10$, and the data voltages on the other portion of the data lines are decreased from V20 to V21, i.e. the negative variation amount of the data voltage is $\Delta V2=V21-V20$, and the positive variation amount of the data voltage $\Delta V1$ is larger than the negative variation amount of the data voltage $\Delta V2$. Under such circumstance, because the entire data voltages have a positive jump, as a portion of the data voltages is overlapped onto the common voltage due to the coupling, it leads to that the common voltage Vcom has a positive voltage fluctuation ash shown as the waveform corresponding to Vcom in FIG. 3. It can be understood that the positive voltage fluctuation of the common voltage Vcom will lead to the unstable voltage of the liquid crystal capacitor, to result in defects of the horizontal crosstalk.

Figure 4:
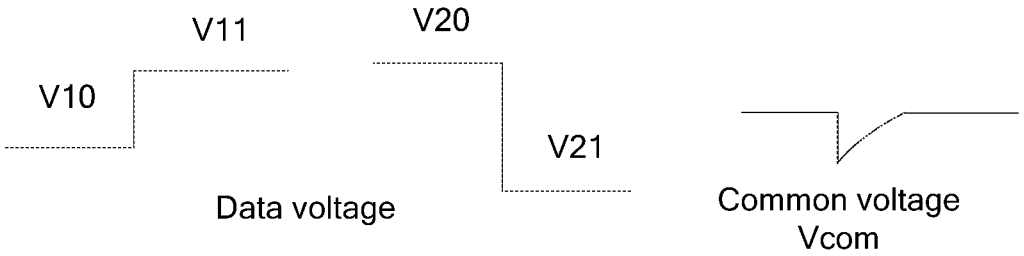
FIG. 4 is a second data voltage jump waveform diagram of a data voltage adjusting method according to the embodiment of the present invention.

Please refer to FIG. 4. In a possible way, it is assumed that the data voltages on a portion of the data lines are increased from V10 to V11, i.e. the positive variation amount of the data voltage is $\Delta V1=V11-V10$, and the data voltages on the other portion of the data lines are decreased from V20 to V21, i.e. the negative variation amount of the data voltage is $\Delta V2=V21-V20$, and the positive variation amount of the data voltage $\Delta V1$ is less than the negative variation amount of the data voltage $\Delta V2$. Under such circumstance, because the entire data voltages have a negative jump, as a portion of the data voltages is overlapped onto the common voltage due to the coupling, it leads to that the common voltage Vcom has a negative voltage fluctuation ash shown as the waveform corresponding to Vcom in FIG. 4. It can be understood that the negative voltage fluctuation of the common voltage Vcom will similarly lead to the unstable voltage of the liquid crystal capacitor, to result in defects of the horizontal crosstalk.

It is assumed that a sum of positive variation amounts of the data voltages on all the data lines in the liquid crystal display panel is $\Sigma\Delta V1$, and a sum of negative variation amounts of the data voltages on all the data lines is $\Sigma\Delta V2$, a total variation amount of data voltages on all the data lines in the liquid crystal display panel is $\Sigma\Delta V=\Sigma\Delta V1+\Sigma\Delta V2$. It can be understood that if $\Sigma\Delta V>0$, the common voltage Vcom will have a positive voltage fluctuation shown in FIG. 3; if $\Sigma\Delta V<0$, the common voltage Vcom will have a negative voltage fluctuation shown in FIG. 4, and both of these two conditions lead to horizontal crosstalk defects.

In this embodiment, for reducing the defects of the horizontal crosstalk, a maximum variation amount of the data voltages can be calculated corresponding to a horizontal crosstalk index according to the horizontal crosstalk index of the liquid crystal display panel. The horizontal crosstalk index is a maximum level of crosstalk acceptable to the liquid crystal panel under the conditions satisfying the display quality required by the products. After calculating the maximum variation amount of the data voltages corresponding to the horizontal crosstalk index, by implementing the data voltage adjustment to the data lines with the data voltages having the variations in the liquid crystal display panel, then an absolute value of the total variation amount $\Sigma\Delta V$ of the data voltages on all the data lines in the liquid crystal display panel is smaller than or equal to a maximum variation amount of the data voltages corresponding to the horizontal crosstalk index.

Figure 5:
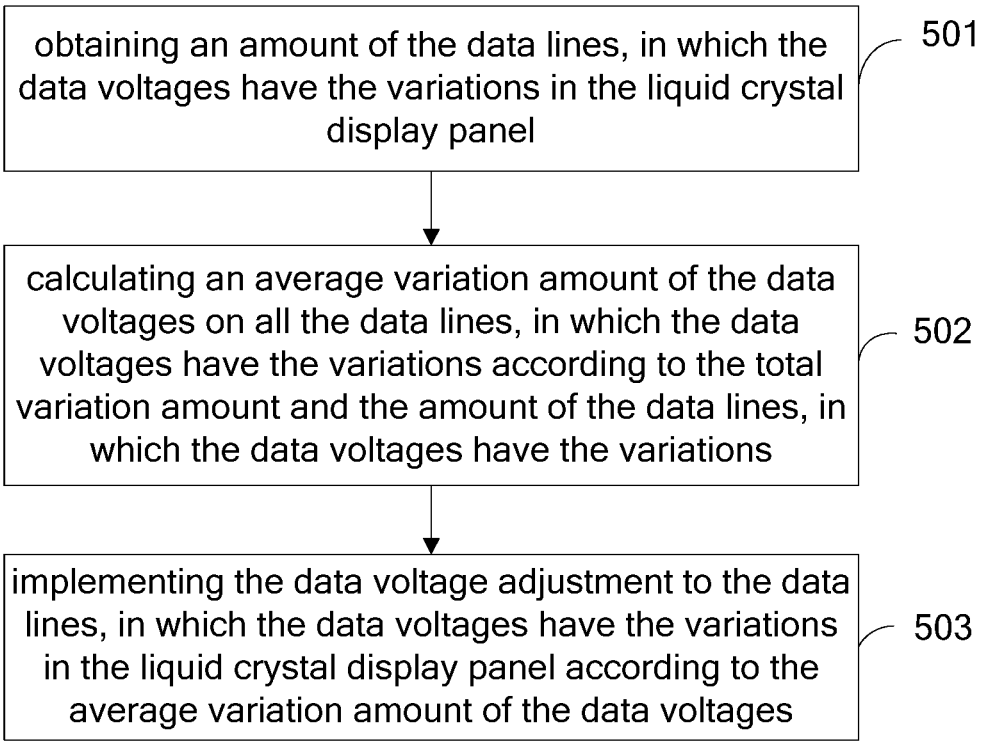
FIG. 5 is a third flowchart of a data voltage adjusting method according to the embodiment of the present invention.

Please refer to FIG. 5. In one embodiment, the step of implementing the data voltage adjustment to the data lines with the data voltages having the variations in the liquid crystal display panel according to the total variation amount of the data voltages comprises:

step 501, obtaining an amount of the data lines with the data voltages having the variations in the liquid crystal display panel;

step 502, calculating an average variation amount of the data voltages on all the data lines with the data voltages having the variations according to the total variation amount and the amount of the data lines with the data voltages having the variations;

step 503, implementing the data voltage adjustment to the data lines with the data voltages having the variations in the liquid crystal display panel according to the average variation amount of the data voltages.

Specifically, it is assumed that an amount of the data lines with the data voltages having the variations in the liquid crystal display panel is n, a total variation amount of data voltages on all data lines in the liquid crystal display panel is $\Sigma\Delta V$, an average variation amount of the data voltages on all the data lines with the data voltages having the variations is $\Sigma\Delta V/n$. The step of implementing the data voltage adjustment to the data lines with the data voltages having the variations in the liquid crystal display panel according to the average variation amount of the data voltages comprises:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

Figure 6:
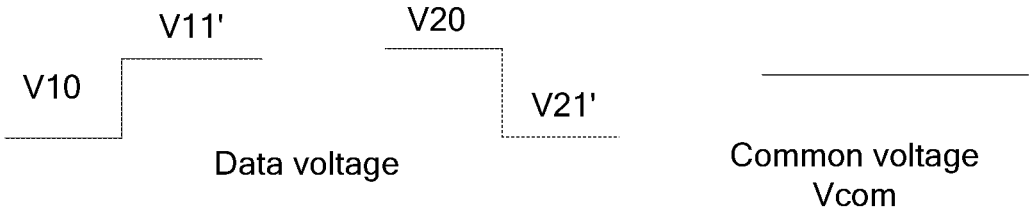
FIG. 6 is a waveform diagram of a data voltage after adjustment according to the embodiment of the present invention.

Please refer to FIG. 3 and FIG. 6. For the condition that the positive variation amount $\Delta V1$ is larger than the negative variation amount $\Delta V2$ shown in FIG. 3, the adjustment to the data voltages V11 and V21 having variations can be: the data voltage V11 is adjusted to be $V11'=V11-\Sigma\Delta V/n$, and the data voltage V21 is adjusted to be $V21'=V21-\Sigma\Delta V/n$. Therefore, the positive variation amount of the data voltage after adjustment is equal to the negative variation amount of the data voltage after adjustment to avoid the influence of the data voltage jump to the common voltage Vcom for ensuring the stability of the common voltage Vcom as shown as the waveform corresponding to Vcom in FIG. 6. It is assumed that $\Delta V1=V11-V10=10V$ is a positive variation amount of the data voltage on one data line, and $\Delta V2=V21-V20=-5V$ is a negative variation amount of the data voltage on the other data line, and an average of the data voltage is $(\Delta V1+\Delta V2)/2=2.5V$, then the positive variation amount of the data voltage after adjustment is $10-2.5=7.5V$ and the negative variation amount of the data voltage after adjustment is $-5-2.5=-7.5V$. An absolute value of the positive variation amounts of the data voltages after adjustment is equal to an absolute value of the negative variation amounts of the data voltages after adjustment.

It can be understood that in one embodiment, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

In this embodiment, by obtaining the total variation amount of data voltages on data lines and the amount of the data lines with the data voltages having the variations in the liquid crystal panel, an average variation amount of the data voltages on all the data lines with the data voltages having the variations is calculated. Thus, the data voltage adjustment is implemented to the data lines with the data voltages having the variations according to the average variation amount so that an absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index to reduce the influence of the data voltage jump to the common voltage of the liquid crystal panel for ensuring the stability of the common voltage to effectively control the level of the horizontal crosstalk defects, thereby promoting the display quality of the liquid crystal display panel.

Figure 7:
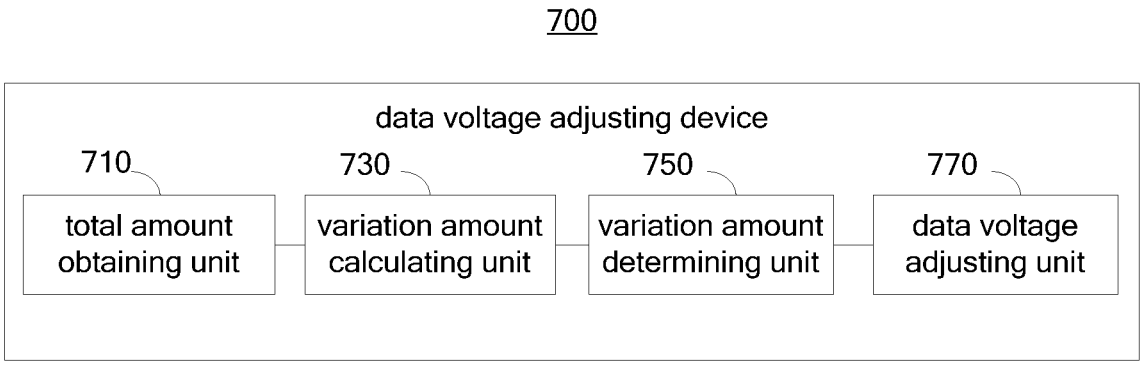
FIG. 7 is a structure diagram of a data voltage adjusting device according to the embodiment of the present invention.

Please refer to FIG. 7. In one embodiment of the present invention, provided is a data voltage adjusting device 700 of a liquid crystal display panel, comprising:

a total amount obtaining unit 710, obtaining a total variation amount of data voltages on all data lines in the liquid crystal display panel;

a variation amount calculating unit 730, calculating a maximum variation amount of the data voltages corresponding to a horizontal crosstalk index according to the horizontal crosstalk index of the liquid crystal display panel;

a variation amount determining unit 750, determining whether an absolute value of the total variation amount of the data voltages is larger than an absolute value of the maximum variation amount of the data voltages corresponding to the horizontal crosstalk index;

a data voltage adjusting unit 770, implementing a data voltage adjustment to data lines with data voltages having variations in the liquid crystal display panel according to the total variation amount of the data voltages when a determining result of the variation amount determining unit is yes.

Figure 8:
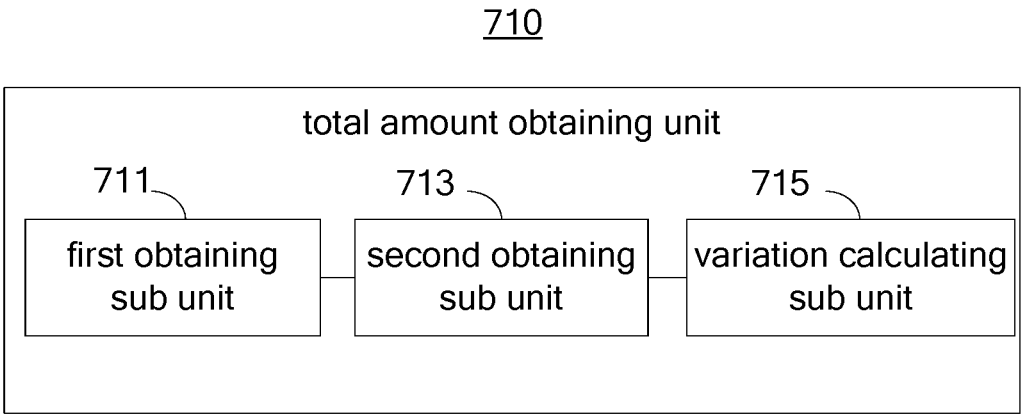
FIG. 8 is a structure diagram of a total amount obtaining unit of a data voltage adjusting device according to the embodiment of the present invention.

Please refer to FIG. 8. In one embodiment, the total amount obtaining unit 710 comprises:

a first obtaining sub unit 711, obtaining a sum of positive variation amounts of the data voltages on all the data lines in the liquid crystal display panel;

a second obtaining sub unit 713, obtaining a sum of negative variation amounts of the data voltages on all the data lines in the liquid crystal display panel;

a variation calculating sub unit 715, calculating the total variation amount of the data voltages on all the data lines in the liquid crystal display panel according to the sum of the positive variation amounts of the data voltages and the sum of the negative variation amount of the data voltages.

Figure 9:
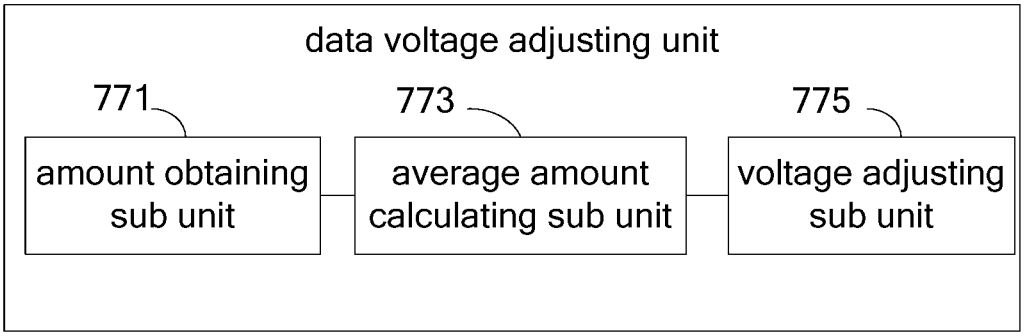
FIG. 9 is a structure diagram of a data voltage adjusting unit of a data voltage adjusting device according to the embodiment of the present invention.

Please refer to FIG. 9. In one embodiment, the data voltage adjusting unit 770 comprises:

an amount obtaining sub unit 771, obtaining an amount of the data lines with the data voltages having the variations in the liquid crystal display panel;

an average amount calculating sub unit 773, calculating an average variation amount of the data voltages on all the data lines with the data voltages having the variations according to the total variation amount and the amount of the data lines with the data voltages having the variations;

a voltage adjusting sub unit 775, implementing the data voltage adjustment to the data lines with the data voltages having the variations in the liquid crystal display panel according to the average variation amount of the data voltages.

In one embodiment, the voltage adjusting sub unit 775 is further employed for:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

An absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

It can be understood that the specific functions and the achievement of the respective units of the data voltage adjusting device 700 may also refer to the related descriptions in the embodiments shown in FIG. 1 to FIG. 6 and will not be described here.

It can be understood that the steps in the method according to the embodiment of the present invention can be order adjusted, divided or deleted according to the actual requirements. The units in the device according to the embodiment of the present invention can be merged, divided or deleted according to the actual requirements. The respective units in the embodiment of the present invention can be integrated in one process unit, or the individual units are physically present, or two or more units are integrated in one unit. The integrated units can be implemented in the form of hardware or in the form of a software functional unit.

The data voltage adjusting method of the liquid crystal display panel and the device according to the embodiment of the present invention obtains a total variation amount of data voltages on all data lines in the liquid crystal display panel, and obtains a maximum variation amount of the data voltages corresponding to a horizontal crosstalk index of the liquid crystal display panel, and thus as an absolute value of the total variation amount of the data voltages is larger than an absolute value of the maximum variation amount of the data voltages corresponding to the horizontal crosstalk index, a data voltage adjustment is implemented to data lines with data voltages having variations in the liquid crystal display panel according to the total variation amount of the data voltages. Accordingly, it can effectively avoid the influence of the overlarge total variation amount of the data voltages to the stability of the common voltage of the liquid crystal display panel to prevent the horizontal crosstalk and to promote the display quality of the liquid crystal display panel.

It can be understood that above are embodiments of the present invention, which does not limit the scope of the present invention. Any modifications, equivalent replacements or improvements within the spirit and principles of the embodiment described above should be covered by the protected scope of the invention.

What is claimed is:

1. A data voltage adjusting method of a liquid crystal display panel, comprising steps of:

obtaining a total variation amount of data voltages on all data lines in the liquid crystal display panel;

calculating a maximum variation amount of the data voltages corresponding to a horizontal crosstalk index of the liquid crystal display panel, wherein the horizontal crosstalk index of the liquid crystal display panel presents a predetermined level of crosstalk exhibited on the liquid crystal display panel and the maximum variation amount of the data voltages indicates a variation amount of the data voltages of the data lines that causes the predetermined level of crosstalk on the liquid crystal display panel;

determining whether an absolute value of the total variation amount of the data voltages is larger than an absolute value of the maximum variation amount of the data voltages corresponding to the horizontal crosstalk index;

if yes, implementing a data voltage adjustment to data lines with data voltages having variations in the liquid crystal display panel according to the total variation amount of the data voltages;

wherein the step of obtaining the total variation amount of the data voltages on all the data lines in the liquid crystal display panel comprises:

obtaining a sum of positive variation amounts of the data voltages on all the data lines in the liquid crystal display panel;

obtaining a sum of negative variation amounts of the data voltages on all the data lines in the liquid crystal display panel;

calculating the total variation amount of the data voltages on all the data lines in the liquid crystal display panel according to the sum of the positive variation amounts of the data voltages and the sum of the negative variation amount of the data voltages by adding up the two sums.

2. The method according to claim 1, wherein the step of implementing the data voltage adjustment to the data lines with the data voltages having the variations in the liquid crystal display panel according to the total variation amount of the data voltages comprises:

obtaining an amount of the data lines with the data voltages having the variations in the liquid crystal display panel;

calculating an average variation amount of the data voltages on all the data lines with the data voltages having the variations according to the total variation amount and the amount of the data lines with the data voltages having the variations;

implementing the data voltage adjustment to the data lines with the data voltages having the variations in the liquid crystal display panel according to the average variation amount of the data voltages.

3. The method according to claim 2, wherein the step of implementing the data voltage adjustment to the data lines with the data voltages having the variations in the liquid crystal display panel according to the average variation amount of the data voltages comprises:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

4. The method according to claim 3, wherein an absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

5. A data voltage adjusting device of a liquid crystal display panel, comprising:

a total amount obtaining unit, obtaining a total variation amount of data voltages on all data lines in the liquid crystal display panel;

a variation amount calculating unit, calculating a maximum variation amount of the data voltages corresponding to a horizontal crosstalk index of the liquid crystal display panel, wherein the horizontal crosstalk index of the liquid crystal display panel presents a predetermined level of crosstalk exhibited on the liquid crystal display panel and the maximum variation amount of the data voltages indicates a variation amount of the data voltages of the data lines that causes the predetermined level of crosstalk on the liquid crystal display panel;

a variation amount determining unit, determining whether an absolute value of the total variation amount of the data voltages is larger than an absolute value of the maximum variation amount of the data voltages corresponding to the horizontal crosstalk index;

a data voltage adjusting unit, implementing a data voltage adjustment to data lines with data voltages having variations in the liquid crystal display panel according to the total variation amount of the data voltages when a determining result of the variation amount determining unit is yes;

wherein the total amount obtaining unit comprises:

a first obtaining sub unit, obtaining a sum of positive variation amounts of the data voltages on all the data lines in the liquid crystal display panel;

a second obtaining sub unit, obtaining a sum of negative variation amounts of the data voltages on all the data lines in the liquid crystal display panel;

a variation calculating sub unit, calculating the total variation amount of the data voltages on all the data lines in the liquid crystal display panel according to the sum of the positive variation amounts of the data voltages and the sum of the negative variation amount of the data voltages by adding up the two sums.

6. The device according to claim 5, wherein the data voltage adjusting unit comprises:

an amount obtaining sub unit, obtaining an amount of the data lines with the data voltages having the variations in the liquid crystal display panel;

an average amount calculating sub unit, calculating an average variation amount of the data voltages on all the data lines with the data voltages having the variations according to the total variation amount and the amount of the data lines with the data voltages having the variations;

a voltage adjusting sub unit, implementing the data voltage adjustment to the data lines with the data voltages having the variations in the liquid crystal display panel according to the average variation amount of the data voltages.

7. The device according to claim 6, wherein the voltage adjusting sub unit is further employed for:

subtracting the average variation amount from the positive variation amounts of the data voltages on the data lines with the data voltages having positive variations to obtain positive variation amounts of the data voltages after adjustment;

subtracting the average variation amount from the negative variation amounts of the data voltages on the data lines with the data voltages having negative variations to obtain negative variation amounts of the data voltages after adjustment.

8. The device according to claim 7, wherein an absolute value of the positive variation amounts of the data voltages after adjustment is equal to an absolute value of the negative variation amounts of the data voltages after adjustment; or, an absolute value of a sum of the positive variation amounts of the data voltages after adjustment and the negative variation amounts of the data voltages after adjustment is smaller than or equal to an absolute value of the maximum variation amount of the data voltages corresponding to the horizontal crosstalk index.

* * * * *